US005306374A

United States Patent [19]

Hambright

[11] Patent Number: 5,306,374

[45] Date of Patent: Apr. 26, 1994

[54] TACKY PATTERN CRAFT TRANSFER PROCESS

[76] Inventor: Perry Hambright, 23515 Oxnard St., Woodland Hills, Calif. 91367

[21] Appl. No.: 989,085

[22] Filed: Dec. 11, 1992

[51] Int. Cl.[5] ..... B32B 31/00

[52] U.S. Cl. ..... 156/247; 156/63; 156/230; 156/239; 156/240

[58] Field of Search ..... 156/230, 247, 63, 235, 156/239, 240, 249

[56] References Cited

U.S. PATENT DOCUMENTS

| | | | |
|---|---|---|---|
| 3,258,381 | 6/1966 | Howe et al. | 156/249 X |
| 3,445,309 | 5/1969 | Milliken | 156/247 X |
| 3,457,625 | 7/1969 | Wanamaker . | |
| 4,302,260 | 11/1981 | Meltzer | 156/63 |
| 4,355,722 | 10/1982 | Lemmeyer . | |
| 4,564,406 | 1/1986 | Binks . | |
| 4,634,616 | 1/1987 | Musante et al. . | |
| 5,096,422 | 5/1992 | Hambright . | |

*Primary Examiner*—David A. Simmons
*Assistant Examiner*—Paul M. Rivard
*Attorney, Agent, or Firm*—Kelly, Bauersfeld & Lowry

[57] ABSTRACT

A handicraft is created on a first medium and temporarily retained thereon for transfer and permanent attachment to a second medium. More particularly, a pattern is printed on one side of a transparent or translucent sheet material. On the opposite side of the sheet material there is a coating of a pressure sensitive temporary adhesive through which a reverse image of the pattern is visible. The outer surfaces of a craft material are then placed onto the sheet material over the pattern and are held thereon by the temporary adhesive. When satisfied with the arrangement of the craft material on the sheet material, a permanent adhesive is applied to the exposed surface of the craft material. The assembly of the craft material and the underlying sheet is then pressed against a desired transfer surface, such as an item of clothing, and kept in place until the permanent adhesive dries. The sheet material bearing the temporary adhesive is then removed from the outer surface of the craft material to leave the handicraft design in place on the transfer surface. In an alternate embodiment the craft material is provided with a thermally reactive glue on one side. Permanent attachment of the handicraft to the transfer surface is effected by applying heat to the handicraft through the sheet material.

20 Claims, 2 Drawing Sheets

FIG. 1
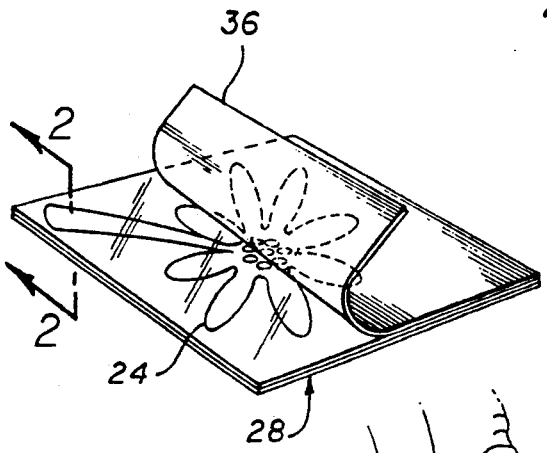
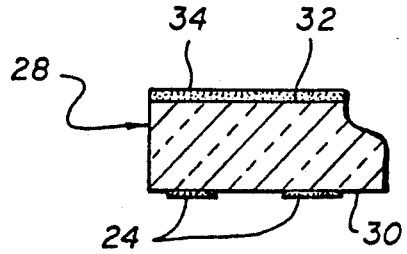
FIG. 2
FIG. 3
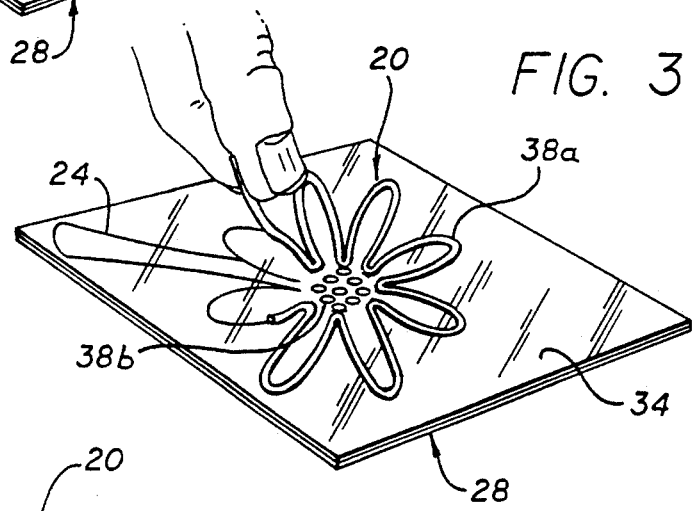
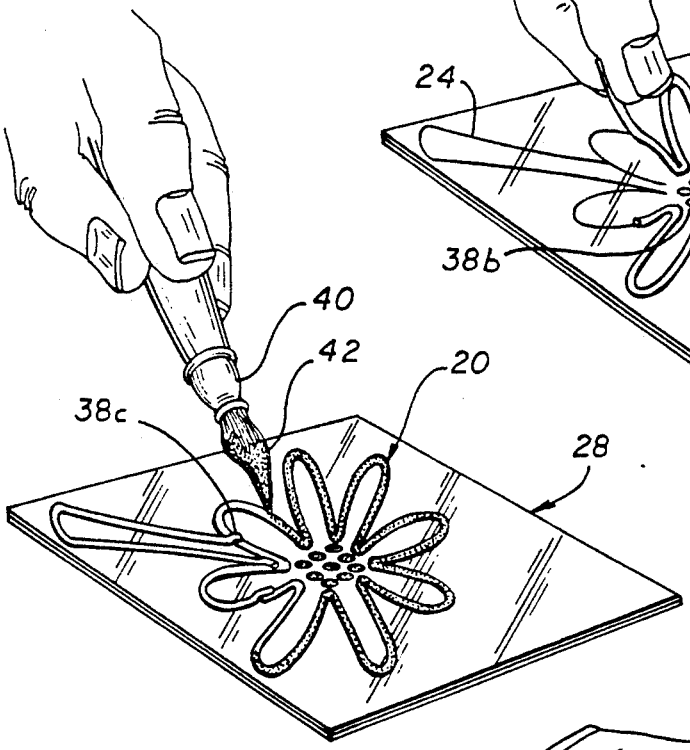
FIG. 4
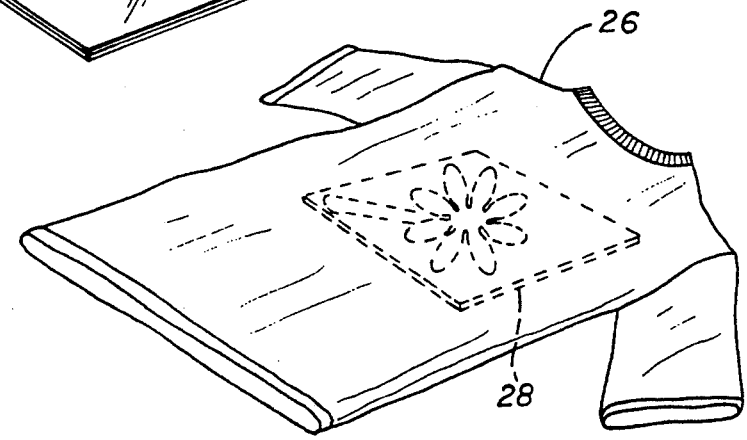
FIG. 5

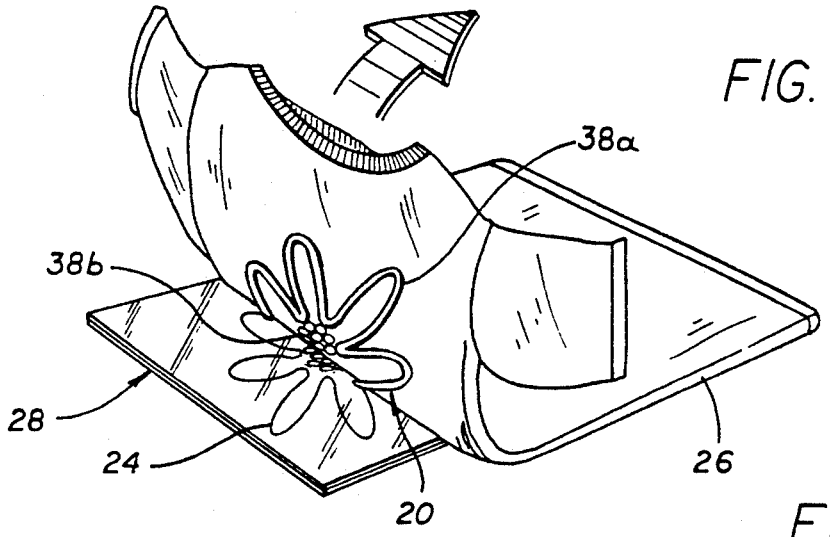
FIG. 6
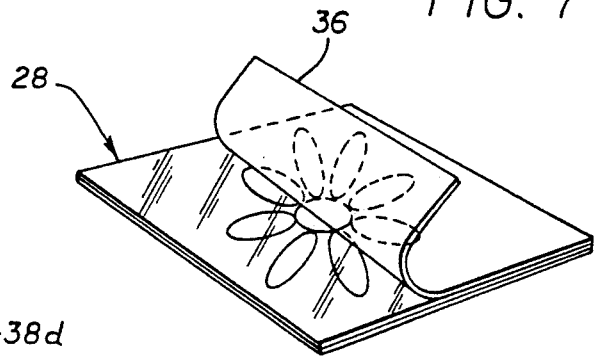
FIG. 7
FIG. 8
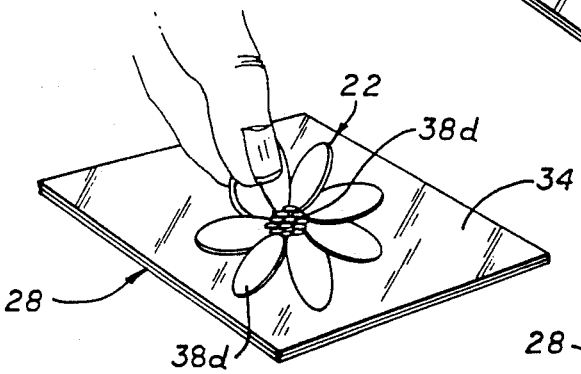
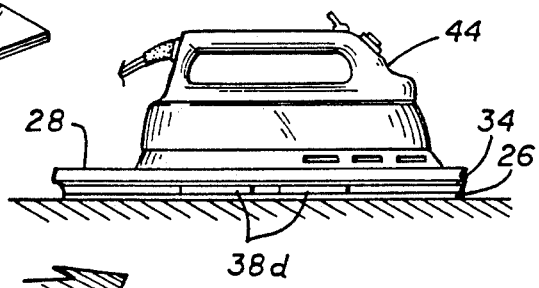
FIG. 9
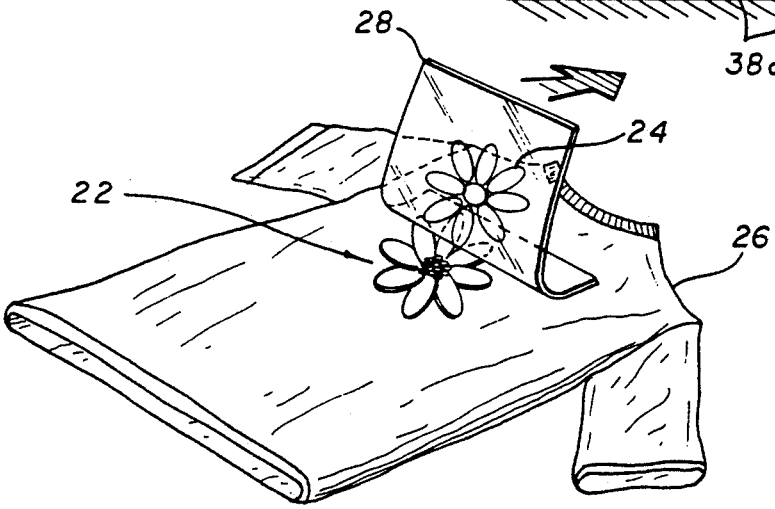
FIG. 10

TACKY PATTERN CRAFT TRANSFER PROCESS

BACKGROUND OF THE INVENTION

This invention relates generally to handicrafts. More particularly, the present invention relates to a process for creating a handicraft in accordance with a selected pattern, and then transferring the handicraft to a desired transfer surface.

The utilizing of handicrafts in conjunction with fabrics has long been known. Besides quilting, there is needle point, cross-stitching and other handicrafts that are based on incorporating yarn of different colors in the form of stitches on fabric. These stitches are to be arranged on the fabric in a specific arrangement forming a desired "picture".

Another way in which a desired "picture" could be achieved on fabric is by utilizing sequins in the form of small flat circular disks which are made in a wide variety of colors. Sequins can be placed on the fabric to form a particular design. The different colors can be utilized to denote certain features within that design. For example, a common design would be a domestic animal such as a dog, cat or bird. There are, of course, many other different types of craft materials which are utilized to form desired "pictures", for example colored cording, felt strips and beads.

The placing of a handicraft on fabric in a desired location generally has been accomplished by two methods. The first method is to have the design reproduced as a chart on graph paper with symbols being utilized to represent different colors. The crafter can duplicate that design onto the fabric by counting from the chart and reproducing the design by utilization of the same count on the fabric.

The second method, sometimes referred to as the "no count" method, simply has the original design painted or printed directly onto the fabric. All the crafter has to do is cover the printed color (or color designated area) with the appropriate matching color of craft material. This method is far faster and easier than counting but it cannot be used in many instances. If, for example, the fabric is black, the printing or painting might be very difficult to observe. Another reason for not utilizing the "no count" method is that only preprinted fabric may be used, which excludes the majority of fabric choices.

Accordingly, there is a need for a handicraft which assists crafters in reproducing designs on mounting surfaces that do not already have the pattern provided thereon. Additionally, such a handicraft is needed which does not require use of a fabric with a grided construction in order to reproduce designs correctly, such as needle point canvas, and which can be utilized with sequins, colored cording, mosaic tile pictures, colored felt pieces and the like. Moreover, a novel process is needed which would permit the craft material to be applied directly over an original printed pattern, and then transferred as a finished handicraft to the final transfer surface. The present invention fulfills these needs and provides other related advantages.

SUMMARY OF THE INVENTION

The present invention resides in a novel process for creating a handicraft and permanently affixing it to a desired transfer surface, such as a fabric garment. The process comprises the steps of providing a first substrate having opposing first and second surfaces, wherein the second surface is coated with a tacky adhesive, and temporarily securing an outer surface of a craft material to the second surface of the first substrate. Here, the craft material can be arranged and rearranged in any desirable manner to create an intended design for the handicraft. The process further includes the steps of permanently attaching an inner surface of the craft material to a second substrate, and then removing the first substrate from the outer surface of the craft material.

In one preferred form of the invention, the process includes the step of applying a pattern to the first substrate by placing the pattern on the first surface of the first substrate such that a reverse image of the pattern is visible through the first substrate on the second surface thereof. This requires that the first substrate be of a transparent or translucent sheet material. A liner is provided over the second surface of the first substrate to protect the tacky adhesive, and must be removed prior to temporarily securing the craft material to the second surface of the first substrate.

During the step of temporarily securing the outer surface of the craft material to the second surface of the first substrate, the craft material is pressed onto the tacky adhesive over the reverse image of the pattern which is visible through the first substrate. Since the tacky adhesive is non-permanent, the craft materials, which may be color cording, beads, sequins, felt strips, etc., may be repositioned as desired to create a desirable handicraft design. Further, there is no requirement that individual pieces of the craft material lie over or adjoin adjacent pieces.

Once the intended design has been created of the craft material on the first substrate over the pattern, a permanent adhesive is applied to the inner surface of the craft material, which is then pressed against the second substrate. More particularly, the step of permanently attaching the inner surface of the craft material to the second substrate includes the steps of applying a permanent glue over the inner surface of the craft material and holding the first substrate in place as the inner surface of the craft material is pressed against the second substrate while the glue dries. Once the glue has dried, the first substrate is removed from the outer surface of the craft material to reveal the handicraft design created initially on the second surface of the first substrate. Of course the craft material can be permanently attached directly to a fabric material, such as a garment.

In a second preferred form of the invention, the step of permanently attaching the inner surface of the craft material to the second substrate includes the steps of treating the inner surface of the craft material with a dry, thermally reactive adhesive, and placing the inner surface of the craft material adjacent to the second substrate. The craft material is then heated to effect the permanent attachment between the craft material and the second substrate. Normally, the heat is applied to the craft material through the first substrate, as by ironing or using another heat emitting device.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIGS. 1-6 illustrate a first embodiment of the process of the present invention, wherein:

FIG. 1 is a perspective view of a transparent or translucent transfer sheet forming a first substrate utilized in connection with the process of the present invention, illustrating an opaque liner being peeled away from a tacky adhesive surface to expose a reverse image of a pattern;

FIG. 2 is an enlarged fragmented sectional view taken generally along the line 2—2 of FIG. 1, illustrating the placement of the pattern on a first surface of the transfer sheet, and a tacky adhesive on a second surface of the transfer sheet;

FIG. 3 is a perspective view similar to FIG. 1, illustrating the transfer sheet with the liner completely removed, and the step of applying craft material onto the tacky second surface over the pattern;

FIG. 4 is a perspective view similar to FIGS. 1 and 3, illustrating the application of a glue to an inner surface of the craft material;

FIG. 5 illustrates the step of bringing the inner surface of the craft material having the glue applied thereto, into contact with a second substrate, here shown as a shirt; and FIG. 6 is a perspective view similar to that shown in FIG. 5, illustrating the step of removing the second substrate (shirt) from the transfer sheet after the glue has dried, completing the transfer of the handicraft from the transfer sheet to the shirt.

FIGS. 7-10 illustrate a second embodiment of the process of the present invention, wherein:

FIG. 7 is a perspective view similar to that shown in FIG. 1, illustrating an opaque liner being peeled away from a tacky adhesive surface of a transfer sheet to expose a pattern;

FIG. 8 is perspective view similar to that shown in FIG. 3, illustrating the placement of the outer surface of a plurality of felt pieces directly over the tacky adhesive surface, wherein the upwardly facing inner surface of the flat fabric craft material has previously been treated with a dry, thermally reactive adhesive;

FIG. 9 illustrates the steps of inverting the transfer sheet bearing the applied craft material, placing it onto a desired second substrate, such as a shirt, and then applying heat through the transfer sheet to the craft material to melt the thermal glue and create a permanent attachment between the craft material and the shirt; and FIG. 10 illustrates removal of the tacky transfer sheet from the underlying shirt after the thermal glue between the craft material and the shirt resolidifies.

DETAILED DESCRIPTION OF THE PREFERRED EMBODIMENTS

As shown in the drawings for purposes of illustration, the present invention is concerned with a process for creating a handicraft which is generally designated in FIGS. 1-6 by the reference number 20 and in FIGS. 7-10 by the reference number 22. More particularly, the present invention relates to a process for creating a handicraft 20, 22 in accordance with a selected pattern 24, and then transferring the handicraft to a desired transfer surface such as a shirt 26.

In accordance with the present invention, and as shown in connection with a first embodiment in FIGS. 1-6, a translucent or transparent transfer sheet 28 is prepared by printing or otherwise applying the pattern 24 onto the first surface 30 thereof. The precise placement of the pattern 24 on the transfer sheet 28 is not critical, so long as a reverse image of the pattern is visible from the second surface 32 of the transfer sheet 28. The transfer sheet 28 is preferably formed of a strong, lightweight plastic or paper material having a tacky, pressure sensitive adhesive 34 pre-applied to the second surface 32 for purposes which will be explained hereinafter. The tacky adhesive 34 must permit the pattern 24 to be visible when viewing the second surface 32. In order to protect the tacky adhesive 34, an opaque liner 36 is placed over the second surface 32.

To initiate the process for creating the handicraft 20, the opaque liner 36 is peeled away from the tacky adhesive 34 (FIG. 1) to uncover the second surface 32 of the transfer sheet 28 and expose the reverse image of the pattern 24. Next, craft materials 38, such as decorative cording 38*a* and sequins 38*b*, are applied to the transfer sheet 28 over the pattern 24 (see FIG. 3). The outer surfaces of the craft materials 38 are pressed onto the tacky adhesive 34 to temporarily secure the craft materials to the transfer sheet. Portions of the craft materials 38 which are not intended to be visible in the finished handicraft 20 are simply placed over another portion of the craft materials as can be seen at overlapping cut end 38*c* in FIG. 4, since the upper exposed portions of the craft materials comprise the inner surface of the handicraft 20 which will not be visible upon completion of the described process.

After the craft materials 38 have been applied to the second surface 32 of the transfer sheet 28, a permanent adhesive is applied over the inner surface of the craft materials. As shown in FIG. 4, a brush 40 or other application tool is utilized to apply a permanent glue 42 over the inner surface of the craft materials 38 which have been arranged over the pattern 24. Care should be taken to apply the glue 42 only to the craft materials 38 and not to the transfer sheet 28. After the glue 42 has been applied, the handicraft 20 is ready to be transferred to a second substrate, such as the shirt 26.

To effect this next step, the shirt 26 may be simply placed over the transfer sheet 28 as shown in FIG. 5 to position the handicraft 20 in the desired location on the shirt. Alternatively, the transfer sheet 28 may be inverted and placed over the shirt 26 in a similar manner. The permanent glue 42 is brought into contact with the fabric material of the shirt 26, and is left in place for a sufficient length of time to enable the glue to cure or harden, thus forming a permanent attachment between the shirt 26 and the handicraft 20. In this regard the tacky adhesive 34 helps to hold the transfer sheet 28 in place over the shirt 26 during the curing/drying process. The transfer sheet 28 is then simply peeled away from the shirt 26 which now has the inner surface of the handicraft securely affixed thereto, to expose the outer surface of the handicraft 20 (FIG. 6).

In a second embodiment of the invention shown in FIGS. 7-10, a similar transfer sheet 28 is provided having a pattern 24 applied thereto and including a tacky adhesive 34 over a second surface 32 which is, in turn, covered with an opaque liner 36. As was done in connection with the first described embodiment, the opaque liner 36 is first peeled away from the transfer sheet 28 to uncover the tacky adhesive 34 applied to the second surface 32, and further to expose the reverse image of the pattern 24 which is visible through the transfer sheet.

In this embodiment however, craft materials 38 are utilized which have a pre-applied dry, thermally reactive adhesive on a inner surface thereof. Such craft materials 38, including the flat fabric pieces 38*d*, are applied over the pattern 24 to form the desired handicraft 22. The outer surfaces of the craft materials 38 are pressed onto the tacky adhesive 34 to expose the inner surfaces bearing the thermally reactive adhesive.

In this embodiment there is no need for a separate step to apply a permanent adhesive to the inner surfaces of the craft materials 38. The transfer sheet 28 bearing the handicraft 22 is simply inverted and placed atop the second substrate or shirt 26, and then heat is applied to melt the thermal glue for purposes of permanently attaching the inner surfaces of the craft materials 38 to the shirt 26. As shown in FIG. 9, an iron 44 can be used for this purpose. Some care must be taken when utilizing the iron-on transfer process of the present invention, in selecting the proper materials for the transfer sheet 28 and the tacky adhesive 34. It would be very undesirable to have a tacky adhesive 34 which also melted as heat was applied by the iron 44 to the shirt 26. An acceptable translucent paper with a tacky adhesive on one side is manufactured by Mask-Off Company of Monrovia, Calif. under the Trademark SHARP LINE 200. The tacky adhesive 34 must withstand the heat of the iron and not become gummy when subjected to the iron-on process.

After heat has been applied through the transfer sheet 28 to melt the thermally reactive adhesive, the handicraft 22 is permitted to cool which permits the thermal glue to resolidify. The transfer sheet 28 may then be peeled away from the shirt 26 (FIG. 10) to reveal the handicraft 22 as applied to the shirt.

From the foregoing it is to be appreciated that the tacky pattern craft transfer process of the present invention offers the ease of assembling the craft materials 38 directly on top of the pattern 24, much like color-by-number and no-count crafts familiar to those in the industry. The process of the present invention features the use of a pressure sensitive adhesive surface which temporarily holds the craft materials 38 in place during assembly of the handicraft 20, 22, as well as holding the completed handicraft during the transfer process. It is very easy to hide loose ends of the craft materials because during the assembly process on the transfer sheet 28, the crafter is working with what will be the inner surface of the handicraft design facing the crafter. The process of the present invention is easy to learn and can be conveniently and economically packaged in attractive handicraft kits.

Although two particular process embodiments of the present invention have been described in detail for purposes of illustration, various modifications of each may be made without departing from the spirit and scope of the invention. Accordingly, the invention is not to be limited, except as by the appended claims.

I claim:

1. A process for creating a handicraft, the steps comprising:

applying a pattern to a first substrate;

arranging a craft material on the first substrate over the pattern;

temporarily securing an outer surface of the craft material to the first substrate, including a step of overlapping portions of adjacent craft material pieces to hide a portion of the craft material in the finished handicraft;

permanently attaching an inner surface of the craft material to a second substrate; and removing the first substrate from the outer surface of the craft material.

2. A process as set forth in claim 1, wherein the step of applying the pattern to the first substrate includes the step of placing the pattern on a first surface of the first substrate such that a reverse image of the pattern is visible through the first substrate on a second surface thereof.

3. A process as set forth in claim 2, wherein prior to temporarily securing the craft material to the first substrate, the process includes the step of removing a liner from the second surface of the first substrate to expose the reverse image of the pattern and a tacky adhesive covering said second surface.

4. A process as set forth in claim 1, wherein the step of temporarily securing the craft material to the first substrate includes the steps of applying a tacky adhesive over a surface of the first substrate through which a reverse image of the pattern is visible, and pressing the outer surface of the craft material onto the surface of the first substrate to be held thereon by the tacky adhesive.

5. A process as set forth in claim 1, wherein the step of permanently attaching the inner surface of the craft material to the second substrate includes the steps of applying a permanent adhesive to the inner surface of the craft material, and pressing the inner surface of the craft material against the second substrate.

6. A process as set forth in claim 5, wherein the step of permanently attaching the inner surface of the craft material to the second substrate includes the steps of applying a permanent glue over the inner surface of the craft material, and holding the first substrate in place as the inner surface of the craft material is pressed against the second substrate while the glue dries.

7. A process as set forth in claim 1, wherein the step of permanently attaching the inner surface of the craft material to the second substrate includes the steps of:

treating the craft material such that the inner surface thereof has a dry, thermally reactive adhesive thereon;

placing the inner surface of the craft material adjacent to the second substrate while remaining attached to the first substrate; and heating the craft material to effect the permanent attachment between the craft material and the second substrate.

8. A process as set forth in claim 7, including the step of applying heat to the craft material through the first substrate.

9. A process as set forth in claim 1, wherein the step of permanently attaching the inner surface of the craft material to the second substrate includes the step of attaching the craft material directly to a fabric material.

10. A process for creating a handicraft, the steps comprising:

providing a first substrate having opposing first and second surfaces, wherein the second surface is coated with a tacky adhesive;

temporarily securing an outer surface of a craft material to the second surface of the first substrate including a step of overlapping portions of adjacent craft material pieces to hide a portion of the craft material in the finished handicraft;

permanently attaching an inner surface of the craft material to a second substrate; and removing the first substrate from the outer surface of the craft material after the craft material is permanently attached to the second substrate.

11. A process as set forth in claim 10, including the step of arranging the craft material on the second surface of the first substrate, over a pattern which is visible through the tacky adhesive.

12. A process as set forth in claim 11, including the step of placing the pattern on the first surface of the substrate such that a reverse image of the pattern is visible through the first substrate on the second surface thereof.

13. A process as set forth in claim 12, wherein the step of temporarily securing the outer surface of the craft material to the second surface of the substrate includes the step of pressing the outer surface of the craft material onto the second surface of the first substrate to be held thereon by the tacky adhesive.

14. A process as set forth in claim 13, wherein the step of permanently attaching the inner surface of the craft material to the second substrate includes the steps of applying a permanent adhesive to the inner surface of the craft material, pressing the inner surface of the craft material against the second substrate, and permitting the adhesive to set-up while in contact with the second substrate.

15. A process as set forth in claim 14, wherein the step of permanently attaching the inner surface of the craft material to the second substrate includes the steps of applying a permanent glue over the inner surface of the craft material, and holding the first substrate in place as the inner surface of the craft material is pressed against the second substrate while the glue dries.

16. A process as set forth in claim 13, wherein the step of permanently attaching the inner surface of the craft material to the second substrate includes the steps of:

treating the craft material such that the inner surface thereof has a dry, thermally reactive adhesive thereon;

placing the inner surface of the craft material adjacent to the second substrate while remaining attached to the first substrate; and heating the craft material to effect the permanent attachment between the craft material and the second substrate.

17. A process as set forth in claim 16, including the step of applying heat to the craft material through the first substrate.

18. A process as set forth in claim 13, wherein prior to temporarily securing the craft material to the first substrate, the process includes the step of removing a liner from the second surface of the substrate to expose the reverse image of the pattern and the tacky adhesive covering said second surface.

19. A process as set forth in claim 13, wherein the step of permanently attaching the inner surface of the craft material to the second substrate includes the step of attaching the craft material directly to a fabric material.

20. A process for creating a handicraft, the steps comprising:

providing a first substrate having opposing first and second surfaces, wherein the second surface is coated with a tacky adhesive;

applying a pattern on the first substrate such that a reverse image of the pattern is visible on the second surface thereof;

arranging a craft material on the second surface of the first substrate over the reverse image of the pattern;

temporarily securing an outer surface of the craft material to the first substrate by pressing the outer surface of the craft material onto the second surface of the first substrate; including a step of overlapping portions of adjacent craft material pieces to hide a portion of the craft material in the finished handicraft;

permanently attaching an inner surface of the craft material to a second substrate, including the steps of applying a permanent adhesive to the inner surface of the craft material and pressing the inner surface of the craft material against the second substrate; and removing the first substrate from the outer surface of the craft material.

* * * * *